United States Patent [19]

Luthi et al.

[11] Patent Number: 4,808,265

[45] Date of Patent: Feb. 28, 1989

[54] METHOD OF WASHING PULP IN A PRESSURE PULP WASHER ADDING TWO WASHING LIQUIDS

[75] Inventors: Oscar Luthi; Frederick S. Lewis, both of Nashua; Lawrence A. Carlsmith, Amherst, all of N.H.

[73] Assignee: Ingersoll-Rand Company, Woodcliff Lake, N.J.

[21] Appl. No.: 124,167

[22] Filed: Nov. 23, 1987

Related U.S. Application Data

[62] Division of Ser. No. 893,988, Aug. 7, 1986, abandoned.

[51] Int. Cl.[4] ..... D21C 9/02; D21C 9/06

[52] U.S. Cl. ..... 162/60; 8/156; 68/43; 162/239; 210/402

[58] Field of Search ..... 162/60, 317, 328, 329, 162/327; 60/45, 22 R, 181 R, 43; 210/392, 402, 409; 8/156

[56] References Cited

U.S. PATENT DOCUMENTS

| | | | |
|---|---|---|---|
| 4,085,003 | 4/1978 | Luthi | 162/259 |
| 4,292,123 | 9/1981 | Lintunen | 162/60 |
| 4,511,088 | 4/1985 | Wilt et al. | 162/60 |
| 4,529,479 | 7/1985 | Tuoni | 162/40 |
| 4,595,456 | 6/1986 | Andersson | 162/60 |
| 4,705,600 | 11/1987 | Jacobson | 162/60 |

*Primary Examiner*—Steve Alvo

*Attorney, Agent, or Firm*—Frank S. Troidl

[57] ABSTRACT

A pulp mat is formed on the outside of a permeable, rotatable drum by feeding a pulp slurry through a mat forming and pressing zone, followed by a mat washing zone. In the mat washing zone, the mat is washed with liquid from a first source and then washed with liquid from a second source.

A washing baffle has a first portion extending from its upstream end partially along the outside surface of the drum and slightly spaced from the outside surface of the drum. This first portion is followed by a second portion extending partially along the outside surface of the drum and spaced further from the outside surface of the drum than the first portion.

3 Claims, 4 Drawing Sheets

METHOD OF WASHING PULP IN A PRESSURE PULP WASHER ADDING TWO WASHING LIQUIDS

This is a division of application Ser. No. 893,988 filed Aug. 7, 1986, now abandoned.

This invention relates to pulp and paper technology. More particularly, this invention is a new and improved pressure pulp washer and method of washing pulp.

In a currently used method of making pulp from wood stock, the wood, which may be in the form of wood chips, is heated in a digester. In the digester, the lignin is chemically dissolved and heated to free the cellulose fibers so that they can be reformed into paper.

The cooked pulp fibers are then blown into a tank where the steam flashes off. Black liquor is added to the blow tank to dilute the stock in the blow tank to say 3½ to 4% consistency. The pulp slurry from the blow tank is then pumped to the inlet box of the pressure washer.

In the pulp washer, a pulp mat is formed from the pulp slurry and the black liquor is extracted. As the pulp slurry enters the forming and pressing zone the differential pressure across the rotating cylinder will start the formation of the pulp mat. The formed mat then goes through the pressing zone where more of the original liquor is extracted. This extraction of the original liquor may be caused by a forming and pressing baffle. The purpose of the baffle is to dewater the formed mat to a high consistency of say, 15 to 20% consistency, without mat disruption, in the shortest time possible.

Split showers on pulp washers to reduce water consumption or to save energy or to save chemicals have been used on vacuum washers. This invention is a new method of washing pulp and a new pulp washer using liquids and/or chemicals from two different sources.

Briefly described, the invention is a pulp washer comprising a vat, a rotatable drum mounted in the vat and a baffle structure constructed to form a pulp mat on the outside surface of the drum. The baffle structure has inside surfaces extending circumferentially along a mat forming and pressing zone and a washing zone and radially separated from the drum outside surface. At least one wash liquid opening extends radially through the baffle structure. A liquid inlet in the vat is located to permit the flow of liquid against the outside surface of the baffle structure, through the wash liquid opening, into the space between the baffle structure and the drum outside surface, and into the drum. The baffle structure also has a baffle liquid inlet downstream from the wash liquid opening and is located to permit the flow of liquid into the space between the baffle structure and the drum outside surface, and into the drum.

Briefly, our new method of forming a pulp mat on the outside of a permeable, rotatable drum mounted in a vat comprises washing the mat with liquid from a first source followed by washing the mat with liquid from a second source.

The baffle structure may consist of a mat forming and pressing baffle for forming and pressing the mat, and a washing baffle having its upstream edge circumferentially separated from the downstream edge of the mat forming and pressing baffle to provide a longitudinal slot through which wash water is flowed into the space separating the washing baffle from the drum.

For some operations, it may be desirable to include an automatic valve mechanism to control the velocity of the liquid through the longitudinal slot so that the liquid velocity approximates the drum velocity. Briefly described, this automatic control valve comprises a wiper mounted on the upstream edge of the washing baffle. A longitudinal valve is adapted to control the velocity of liquid flow through the longitudinal slot. The valve surface facing the drum is continuously in contact with the wiper. Means are provided which interconnect the valve, the mat forming and pressing baffle, and the washing baffle. The interconnecting means is constructed to widen and narrow the longitudinal slot and to move the upstream edge of the washing baffle radially outwardly and inwardly, respectively, when the downstream edge of the mat forming and pressing baffle moves outwardly and inwardly, respectively, in response to mat thickness variations.

The invention, as well as its many advantages, may be further understood by reference to the following detailed description and drawings in which.

In the various figures, like parts are referred to by like numbers.

Figure 1:
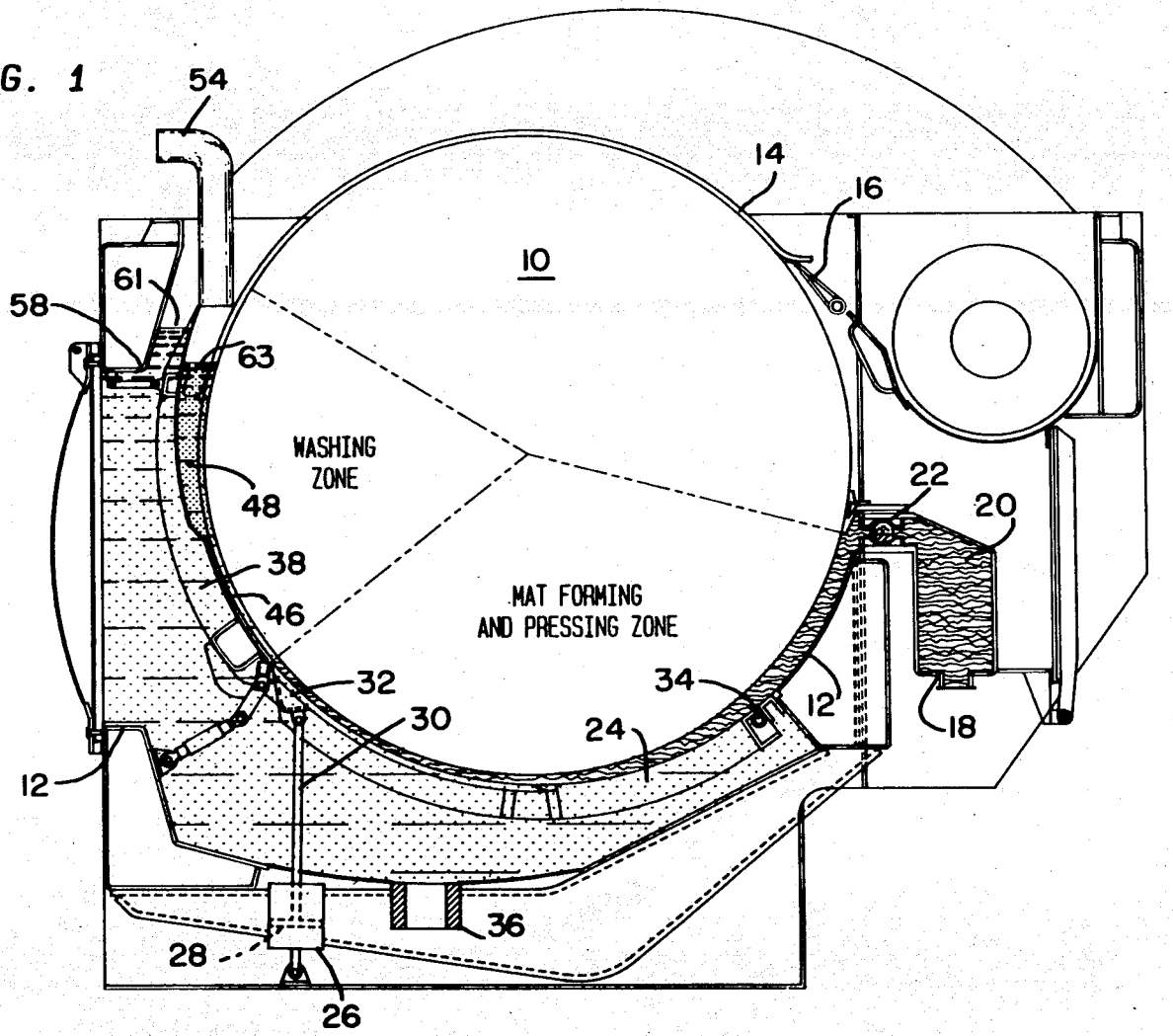
FIG. 1 is a front schematic view, partly in section, showing the new washer.

Referring to the drawings and more particularly to FIG. 1, the pulp washer is a wire cloth covered cylinder 10 which rotates in a vat 12. By means of internal valving (not shown), differential pressure is applied radially inwardly toward the drum axis as the rotating cylinder enters the pulp slurry. The black liquor drains inwardly through the wire cloth (not shown), leaving a pulp mat 14 on the face of the wire. The pulp mat is held there by differential pressure. As the cylinder 10 continues to rotate clockwise, the pulp mat adhering to the wire emerges from the slurry. Black liquor continues to drain from the pulp as a result of the differential pressure. Finally, the pressure differential is cut off and the washed pulp mat 14 is removed from the wire of the cylinder by the scraper 16 just before the cycle is repeated.

The pulp slurry, which may be 4% or higher in consistency, is fed through the pulp conduit 18 into the pulp slurry inlet box 20. Pulp slurry then flows through the valve 22 and into the space between the outside periphery of rotatable cylinder 10 and the inside surface of the vat 12. The pulp slurry begins to form into the mat 14 in the mat forming and pressing zone. A mat forming and pressing baffle 24, mounted downstream from the pulp slurry inlet box 20 applies a compacting force against the mat being formed. The compacting force is applied by means of a pneumatic or hydraulic cylinder 26 containing piston 28. Piston rod 30 is connected at one end to a bracket 32 on the radially outside surface of the baffle 24 and at the other end to piston 28. The mat forming and pressing baffle 24 pivots about pivot 34. The force exerted against the baffle 24 by the hydraulically or pneumatically operated means is such that as the mat becomes thicker the mat forming and pressing baffle 24 will move radially outwardly about pivot 34 and as the mat becomes thinner, the baffle 24 will move radially inwardly about the pivot 34.

Figure 6:
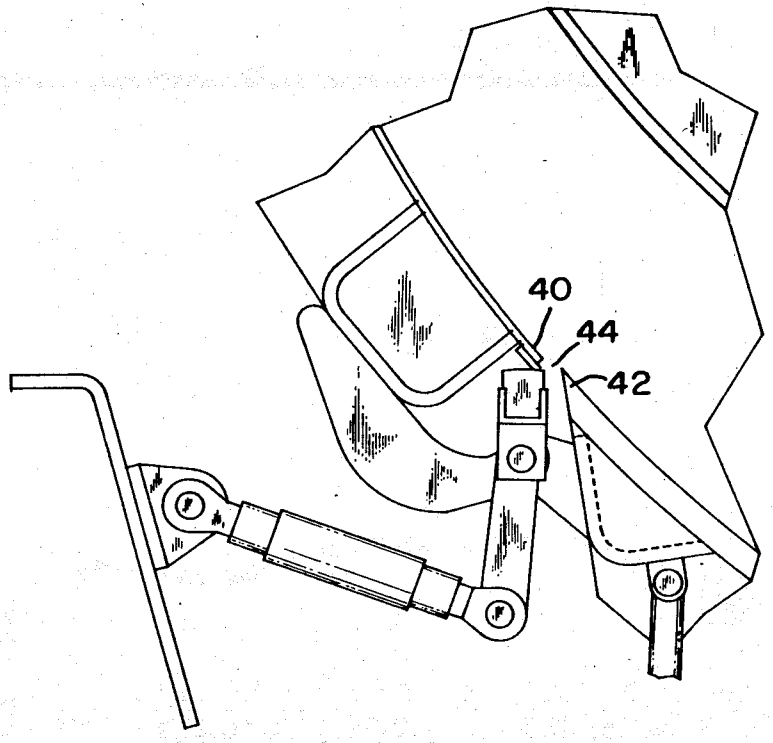
FIG. 6 is a view similar to FIG. 4 but showing the valve mechanism in the retracted position.

Wash water enters the vat 12 through wash water inlet 36. A washing baffle 38 is located downstream from the mat forming and pressing baffle 24. The upstream edge 40 (see FIG. 4 and FIG. 6) of the washing baffle 38 is circumferentially separated from the downstream edge 42 of the mat forming and pressing baffle 24. This separation provides a longitudinal slot 44 (see FIG. 4 and FIG. 6) through which the first wash liquid entering the vat through inlet 36 (see FIG. 1) flows into the space separating the washing baffle 38 from the drum.

Figure 3:
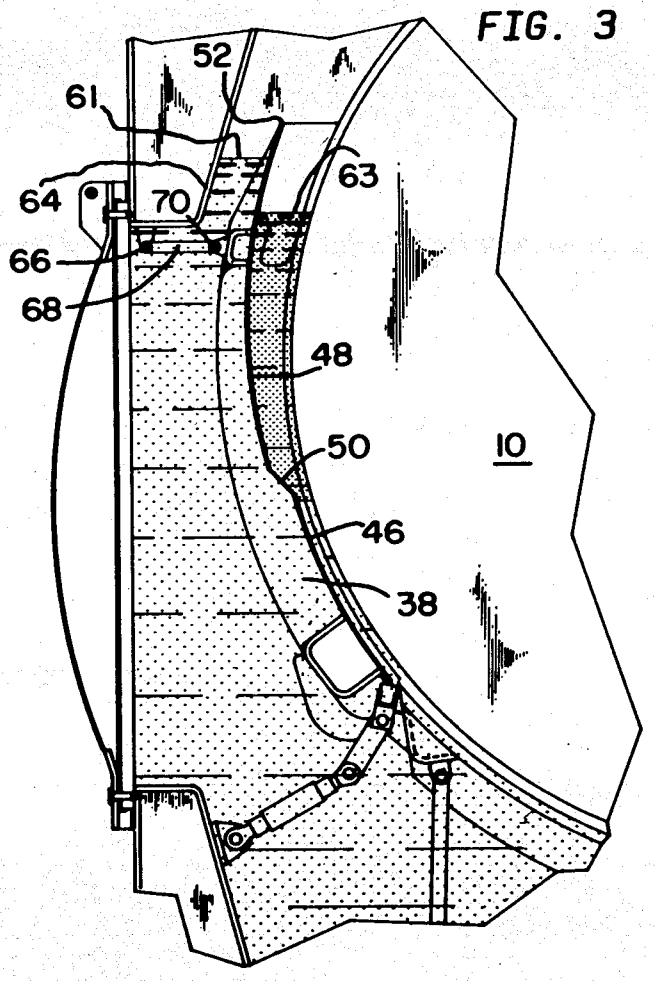
FIG. 3 is a fragmentary view of FIG. 1, on an enlarged scale, of the baffle structure.

Referring to FIG. 3, the washing baffle 38 has an inside surface 46 extending from its upstream end and partially along the outside surface of the drum 10 and a second inside surface 48 extending partially along the outside surface of the drum and spaced further from the outside surface of the drum than the first portion 46. A tapered surface 50 interconnects the surfaces 46 and 48. Surface 48 extends to the downstream end 52 of the washing baffle 38.

The inside surface 46 of the washing baffle 38 is generally concentric to the outside periphery of the drum 10. The inside surface 48 of the washing baffle 38 is arcuate but generally diverges radially outwardly from the outside surface of the drum 10 as the surface 48 progresses from the end of the tapered surface 50 to the downstream edge 52 of the washing baffle 38.

Figure 2:
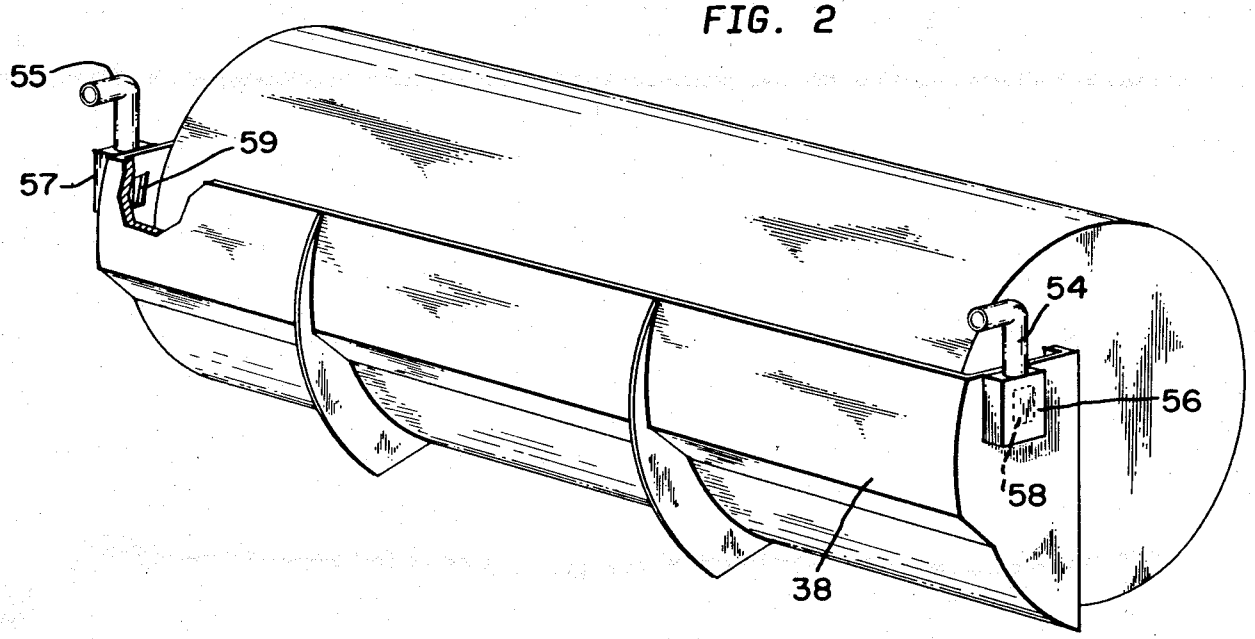
FIG. 2 is a perspective view of the washing baffle and its relationship to the drum during operation.

FIG. 2 shows the drum 10 and the washing baffle 38 with all other parts removed. Referring to FIG. 2 and FIG. 3, washing baffle 38 extends along the entire length of the drum 10. The top of the washing baffle 38 may be open. A second liquid is fed into the space separating the outside periphery of the drum 10 from the surface 48 of the washing baffle 38 by means of the liquid pipes 54 and 55, liquid boxes 56 and 57 and liquid inlet holes 58 and 59.

Figure 5:
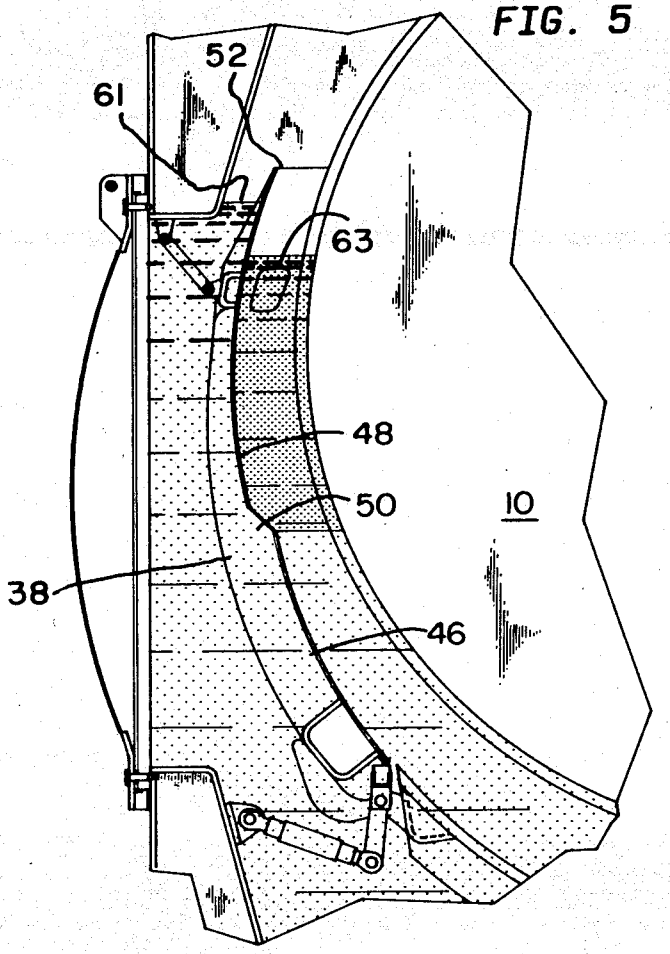
FIG. 5 is a view similar to FIG. 3 but showing the washing baffle and automatic valve in the retracted position.

Referring to FIG. 1, FIG. 3, and FIG. 5, note that the top level 61 of the liquid fed into the vat through liquid inlet 36 is above the top level 63 of the liquid fed into the space separating the drum and the washing baffle 38 through pipes 54 and 55. Access to the pulp mat for the first liquid is through slot 44. At the upstream end, the washing baffle has a narrow gap between the pulp mat and baffle. The first liquid flows in this gap and along the narrow annulus at a velocity which matches approximately the velocity of the drum and is forced through the pulp mat into the drum. At the point at or just before all the first liquid has flowed into the pulp mat, the washing baffle gap is rapidly enlarged. The second liquid is fed into this enlarged section from the top and is forced through the mat in the enlarged gap section. The narrow gap separating the mat 14 from the inside surface 46 of the baffle 38 prevents excessive mixing of the two liquids.

The lengths of the surfaces 46 and 48 are related to the desired split of wash liquid. The length of surface 46 is proportional to the percent split of the first liquid.

The length of the surface 48 is proportional to the percent split of the second liquid.

Figure 4:
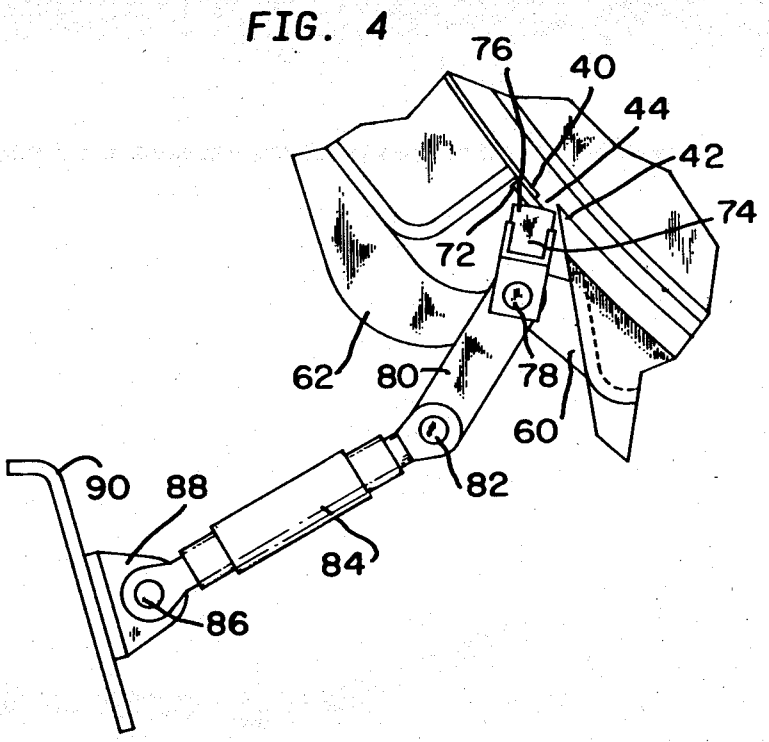
FIG. 4 is a fragmentary view on an enlarged scale, of the valve mechanism used to control the velocity of liquid flowing through the slot separating the mat forming and pressing baffle from the washing baffle.

Referring to FIG. 3 and FIG. 4, brackets 60 and 62 interconnect the mat forming and pressing baffle 24 and the washing baffle 38. The downstream end of the washing baffle 38 is connected to the bracket 64 of the vat by means of a pivot 66, arm 68 and pivot 70. Thus, as the mat forming and pressing baffle 24 moves radially inwardly or outwardly in response to the thickness of the mat being formed in the pressing and forming zone, the upstream edge of the washing baffle 38 will also move outwardly or inwardly, respectively, to provide for the proper spacing for the flow of liquids in response to changes in mat thickness.

The upstream edge of the washing baffle 38 has a wiper 72 attached to it. A longitudinal valve 74 controls the velocity of the flow of liquid through the longitudinal slot 44. The surface 76 of the valve 74 faces the drum 10. Surface 76 of valve 74 is continuously in contact with the wiper 72. Surface 76 is a convex surface and the surface of the wiper 72 continuously in contact with the surface 76 a complementary concave surface. A pin 78 extends loosely through aligned holes (not shown) in brackets 60 and 62 and in a mechanical linkage arm 80. The valve 74 is fixedly connected to the outer ends of shaft 78. Thus, the valve 74 rotates with any rotation of the shaft 78.

The mechanical linkage 80 is pivotally connected through pin 82 to a mechanical linkage 84 which is pivotally connected by means of pin 86 to a lug 88 attached to the bracket 90 of the vat.

In operation, referring to FIG. 1, the pulp slurry is fed through pulp slurry conduit 18, slurry inlet box 20, and valve 22 into the space separating the drum 10 from the baffle 24. The drum is rotated clockwise and a differential pressure developed across the drum 10. As the drum rotates, the liquid in the pulp slurry is removed into the center of the drum and the mat 14 starts to form. As the mat leaves the downstream edge of baffle 24, it is washed in the washing zone by first the liquid from inlet 36 which flows through the slot 44 (see FIG. 4.) and then further washed by the liquid fed through pipes 54 and 55 into the space separating the drum from the surface 48 of the washing baffle 38. The two liquids may be at different temperatures and/or be two different chemicals. The washed mat is removed from the drum 10 by means of the scraper 16. As the mat forming and pressing baffle 24 automatically moves radially inwardly or outwardly in response to changes in thickness of the mat, the upstream edge of the washing baffle 38 is also moved inwardly and outwardly, respectively, because of the brackets 60 and 62 interconnecting the baffle 24 and the baffle 38.

Also, as the mat forming and pressing baffle 24 moves radially inwardly or outwardly, the valve 74 is automatically adjusted so that the slot 44 is increased or decreased, respectively, to adjust the velocity of liquid flowing through the slot.

The valve 74 has its surface 76 kept clean by the wiping action of the wiper 40 in contact with the surface. Plugging of the slot 44 by pulp fibers is also prevented.

FIG. 3 and FIG. 4 show the positions of the parts during the operation of the system to form the mat 14. When the system is not in operation, the mat forming and pressing baffle and the washing baffle are retracted to the positions shown in FIG. 5 and FIG. 6.

As used in this description and the appended claims, the words "upstream" and "downstream" are used with reference to the clockwise rotation of the drum and generally clockwise movement of the pulp slurry and pulp mat. For example, the farthest upstream point is where the pulp slurry enters the space between the drum and the vat 12 and the farthest downstream point is at the scraper 16.

We claim:

1. A method of washing a pulp mat on the outside of a permeable rotatable drum mounted in a vat and a washing baffle also mounted in the vat and having a first inside surface spaced from the drum by a narrow gap to provide a narrow annulus extending from its upstream end partially along the outside surface of the drum and a second inside surface downstream from the first inside surface, connected to the first inside surface and extending partially along the outside surface of the drum to its downstream end with the second inside surface spaced from the drum by an enlarged gap to provide an enlarged annulus comprising the steps of: moving the pulp mat, by rotating athe drum, form the upstream end of the narrow gap to the downstream end of the enlarged gap, washing the mat with liquid from a first liquid source by flowing said liquid into said upstream end of the narrow gap, along the narrow annulus and through the pulp mat into the drum; and washing the mat with liquid from a second liquid source by flowing said liquid into said downstream end of the enlarged gap, along the enlarged annulus and through the pulp mat into the drum.

2. The method of washing a pulp mat in accordance with claim 1 wherein the liquid from the second liquid source flows in a direction counter to the direction of flow of liquid from the first liquid source.

3. The method of washing a pulp mat in accordance with claim 2 wherein the first liquid is flowed at a velocity which approximately matches the velocity of the drum.

* * * * *